US006666727B2

(12) United States Patent
Konno et al.

(10) Patent No.: US 6,666,727 B2
(45) Date of Patent: Dec. 23, 2003

(54) CONNECTOR COMPOSED OF CONNECTOR SOCKET AND MATED CONNECTOR

(75) Inventors: Takeshi Konno, Ibaraki (JP); Akihito Sukegawa, Ibaraki (JP); Shinichi Asano, Ibaraki (JP)

(73) Assignee: Mitbumi Electronic Co. LTD (JP)

( * ) Notice: Subject to any disclaimer, the term of this patent is extended or adjusted under 35 U.S.C. 154(b) by 0 days.

(21) Appl. No.: 10/113,130

(22) Filed: Mar. 29, 2002

(65) Prior Publication Data

US 2002/0142668 A1 Oct. 3, 2002

(30) Foreign Application Priority Data

Mar. 30, 2001 (JP) ..... 2001-097985

(51) Int. Cl.[7] ..... H01R 13/10
(52) U.S. Cl. ..... 439/682; 439/680; 439/633
(58) Field of Search ..... 439/680, 682, 439/633, 630

(56) References Cited

U.S. PATENT DOCUMENTS 3,566,340 A * 2/1971 Jayne et al. ..... 439/633
4,767,342 A * 8/1988 Sato ..... 439/381
4,979,910 A * 12/1990 Revil et al. ..... 439/357
5,254,018 A * 10/1993 Sawada ..... 439/680
5,549,480 A * 8/1996 Cheng ..... 439/682
5,865,651 A * 2/1999 Dague et al. ..... 439/218
5,885,088 A * 3/1999 Brennan et al. ..... 439/378
5,902,155 A * 5/1999 Polgar et al. ..... 439/353
6,364,718 B1 * 4/2002 Polgar et al. ..... 439/488

* cited by examiner

*Primary Examiner*—P. Austin Bradley
*Assistant Examiner*—Edwin A. León
(74) *Attorney, Agent, or Firm*—Patents + TMS, P.C.

(57) ABSTRACT

A connector which includes a connector socket and a mated connector plug to be fitted into the connector socket has a socket body which includes upper and lower terminal holding portions. The upper and lower terminal holding portions each have a plurality of terminals which are arranged in a row along the width direction of the socket body. The upper and lower terminal holding portions are arranged so as to face each other through a predetermined spacing. The connector socket further has a rib for maintaining the spacing between the upper and lower terminal holding portions for preventing both the terminal holding portions from being deformed so that they approach each other. The rib is integrally formed with the upper and lower terminal holding portions and arranged substantially at the center of the width direction of the socket body. The mated connector plug has a plate member which is inserted into the spacing when the connector plug is connected to the connector socket.

3 Claims, 4 Drawing Sheets

CONNECTOR COMPOSED OF CONNECTOR SOCKET AND MATED CONNECTOR

BACK GROUND OF THE INVENTION

1. Field of the Invention

This invention relates to a connector, and in particular relates to a connector composed of a connector socket and a mated connector plug to be connected to the connector socket for transmitting and receiving electric signals and supplying electrical power and the like.

2. Description of the Prior Art

Connectors are widely used in automobiles or the like for establishing electrical connections between wire harnesses and between a wire harness and an electric device, and the like.

Normally, each connector is composed from a connector socket and a connector plug which is connected to the connector socket.

One example of the conventional connector socket includes a socket body 11 which is made of resin, and a front end face of the socket body has such a shape as shown in FIG. 4. A plurality of terminals (not shown in the drawings) are provided in the socket body so that these terminals make contact with contact pins provided in the connector plug when the connector plug is connected to the connector socket.

The socket body 11 includes upper and lower terminal holding portions 16*a,* 16*b* in which the plurality of terminals (contacts) are arranged in a row in the width direction of the connector socket. Further, there is provided a spacing 21 between both the upper and lower terminal holding portions 16*a,* 16*b*.

The socket body 11 used in such a conventional connector is formed by, for example, injection molding using a thermoplastic resin such as polybutylene terephthalate (PBT). However, since the socket body 11 has a structure in that the spacing 21 is provided between the upper and lower terminal holding portions 16*a,* 16*b* as shown in FIG. 4 (*a*), there is a case that after such injection molding the central portions of both the terminal holding portions 16*a,* 16*b* are warped inward toward the spacing 21 as shown in FIG. 4 (*b*), that is, in the direction shown by the arrows in FIG. 4 (*b*). Such deformation is liable to be caused due to extension of the resin material or residual stress in the material at the time of the injection molding while the connector socket 11 is still being softened by heat.

If the socket body 11 is warped inwardly as described above, there is a case that poor electrical connection will occur between the terminals provided in the connector socket and the connector plug. Further, there is also a case that it becomes difficult for the contact pins provided in the connector plug to be inserted into the terminals of the socket body 11 properly.

SUMMARY OF THE INVENTION

In view of such problems described above, it is therefore an object of the present invention to provide a connector having a connector socket in which warpage of terminal holding portions by heat or the like is difficult to occur with a simple structure.

In order to achieve the object mentioned above, the present invention is directed to a connector which includes a connector socket and a mated connector plug to be connected to the connector socket. The connector socket comprises a socket body which includes first and second terminal holding portions each having a plurality of terminals which are arranged in a row along the width direction of the socket body, the first and second terminal holding portions being arranged so as to face with each other through a predetermined spacing in upper and lower relationship; and means for preventing both the terminal holding portions from being deformed so that they approach to each other.

In the connector of the present invention described above, it is preferred that the deformation preventing means is provided so as to maintain the spacing between the first and second terminal holding portions.

Preferably, the deformation preventing means is arranged substantially at the center of the width direction of the socket body.

More preferably, the deformation preventing means is a rib which is integrally formed with the first and second terminal holding portions so as to connect these portions together.

Further, in the present invention, it is preferred that each of the terminals has a tip portion and a base portion, and each of the first and second terminal holding portions has a front side in which the tip portion of each terminal is positioned and a rear side in which the base portion of each terminal is positioned, wherein the rib is formed so as to connect the front sides of the first and second terminal holding portions.

Preferably, the rib is formed so as to connect the first and second terminal holding portions from the front sides thereof to the rear sides thereof.

Further, in the present invention, it is preferred that the socket body is formed of an insulating material.

Furthermore, in the present invention, it is also preferred that the mated connector plug includes a plate member which is inserted into the spacing between the first and second terminal holding portions when the connector plug is connected to the connector socket.

In this case, it is preferred that the plate member of the connector plug is configured so as not to interfere with the deformation preventing means when the connector plug is connected to the connector socket.

According to the connector of the present invention described above, since the deformation preventing means for preventing the first and second terminal holding portions from being deformed inwardly is provided, even when the connector becomes in a softened state by heat after injection molding, the connector is prevented from being deformed so that the fisrt and second terminal holding portions thereof approach to each other.

These and other objects, structures and advantages of the present invention will be apparent from the following description of the preferred embodiment when it is considered taken in conjunction with the appended drawings.

BRIEF DESCRIPTION OF THE DRAWING

FIG. 4 (*b*) is a schematic view which shows the connector socket of the conventional connector shown in FIG. 4(*a*) after deformation.

DETAILED DESCRIPTION OF THE INVENTION

Hereinbelow, a preferred embodiment of the present invention will be described in detail with reference to the accompanying drawings.

Figure 1:
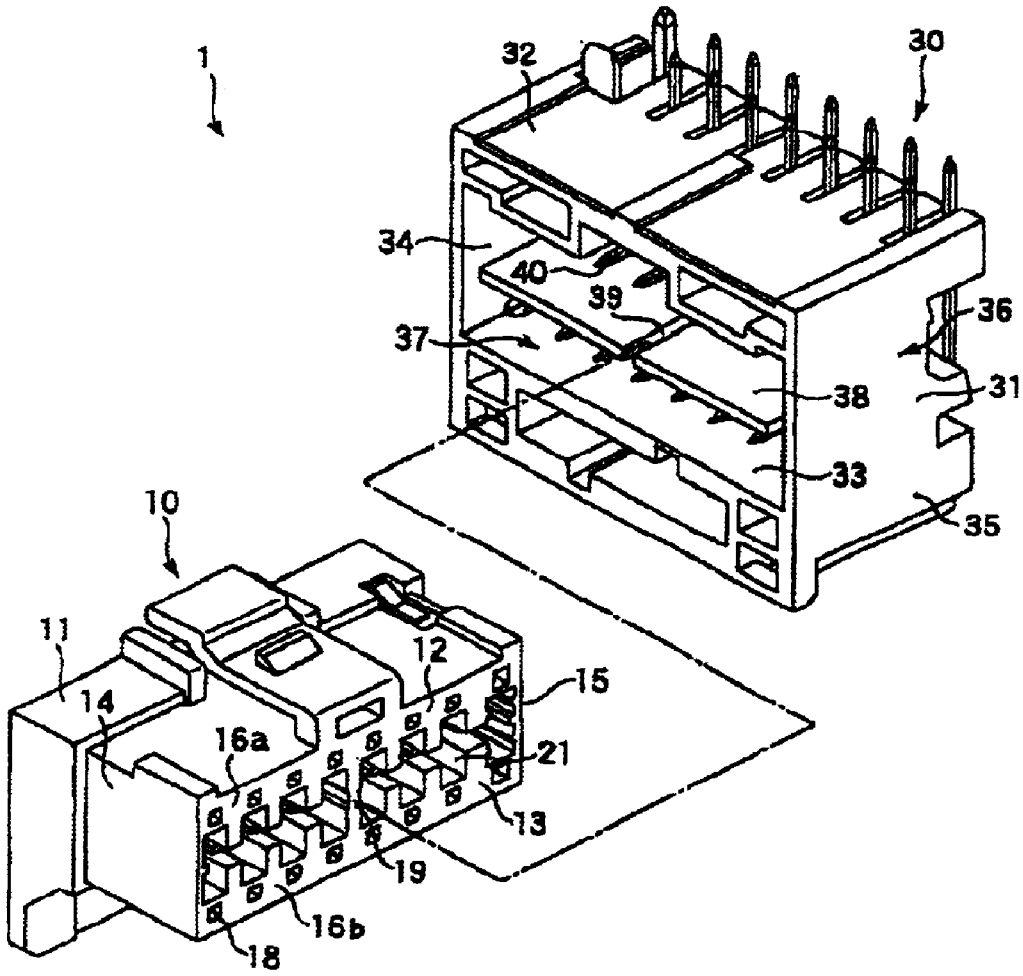
FIG. 1 is a perspective view which shows the overall structure of a connector of the present invention.
Figure 2:
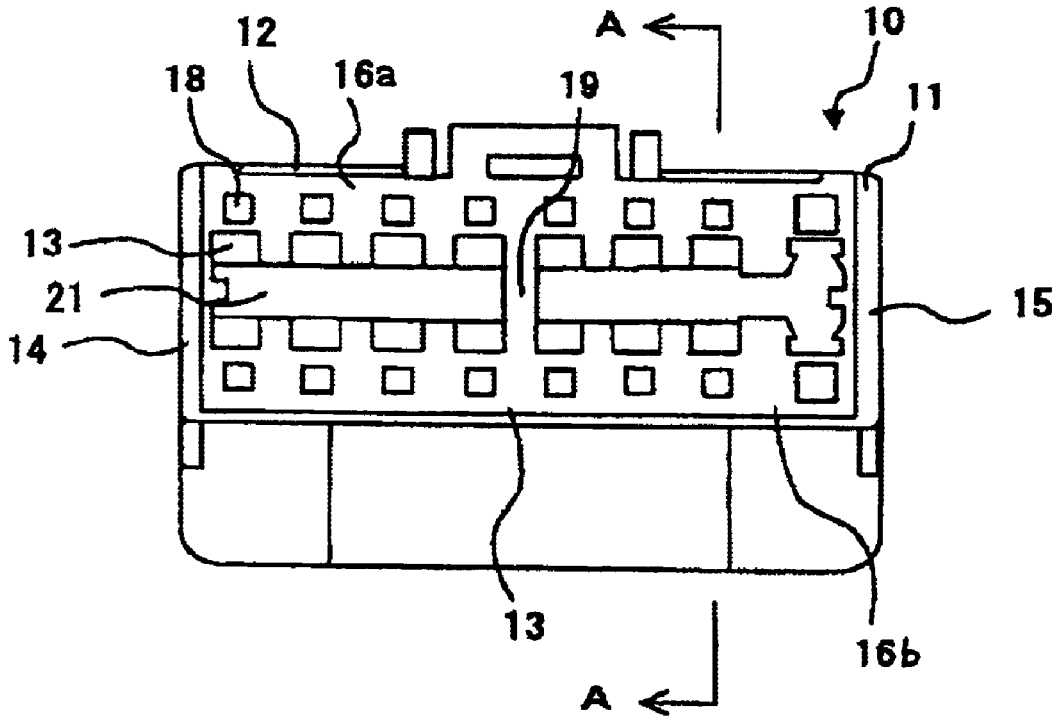
FIG. 2 is a front view of a connector socket according to the connector of the present invention.
Figure 3:
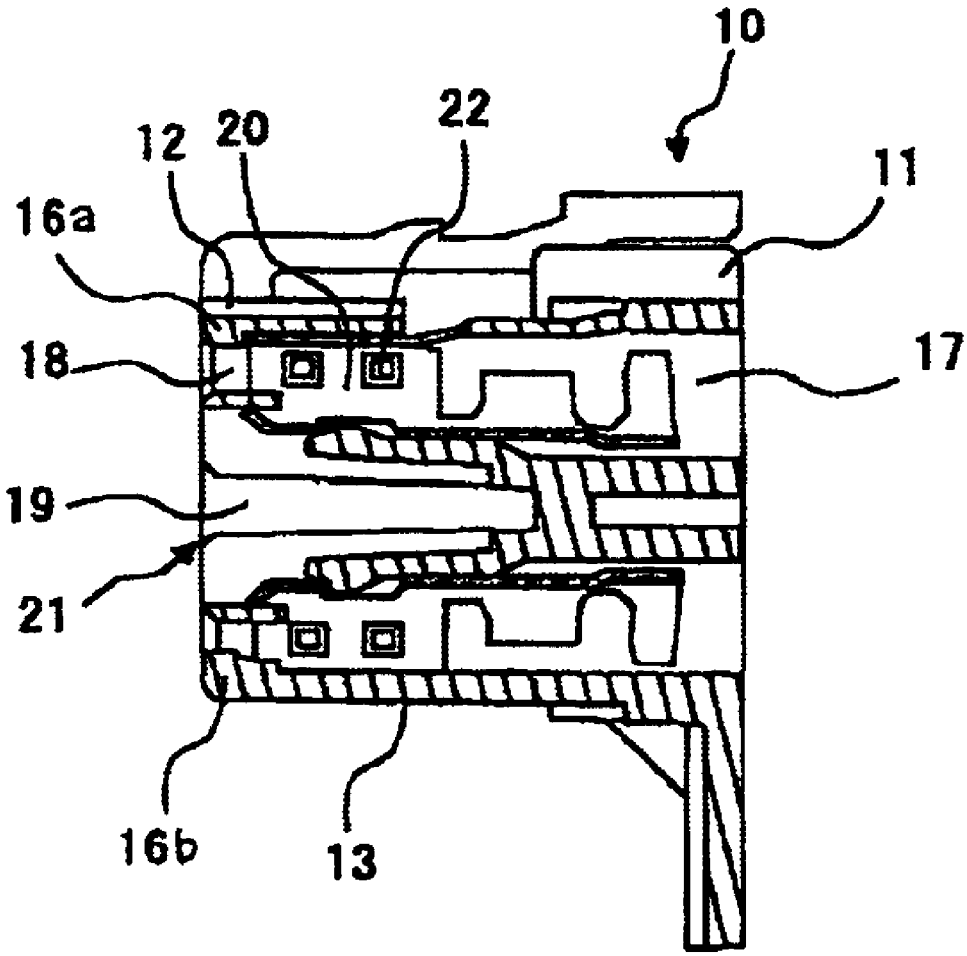
FIG. 3 is a sectional view of the connector socket taken along the A–A' line in FIG. 2.
Figure 4:
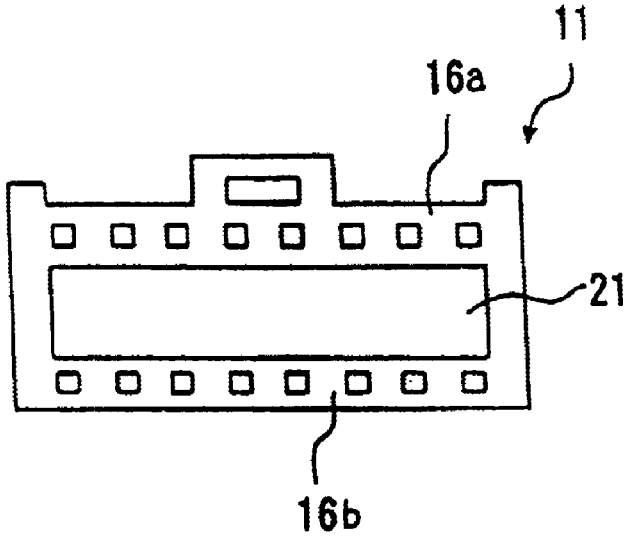
FIG. 4 (a) PRIOR ART
FIG. 4 (*a*) is a schematic view which shows a connector socket of a conventional connector before deformation.
Figure 4:
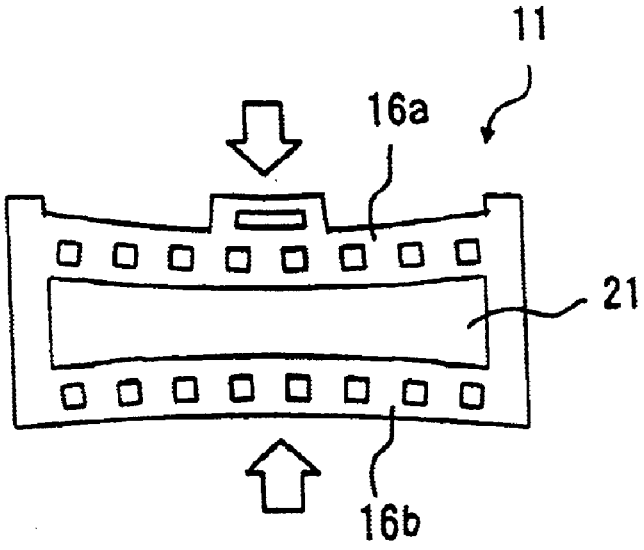
FIG. 4 (b) PRIOR ART

FIG. 1 is a perspective view which shows the overall structure of a connector of the present invention. FIG. 2 is a front view which shows a connector socket according to the connector of the present invention. FIG. 3 is a cross sectional view of the connector socket taken along the A–A' line in FIG. 2.

A connector 1 of the present invention is composed from a connector socket 10 and a connector plug 30 which is to be connected to the connector socket 10.

As shown in FIG. 1, the connector socket 10 includes a socket body 11 made of a thermoplastic resin such as polybutylene terephthalate (PBT) or the like, and a plurality of electrical terminals 20 (see FIG. 3) provided in the socket body 11 to make contact with contact pins 40 provided in the connector plug 30 described later.

As shown in FIG. 2, the socket body 11 is formed to have a substantial angular tube shape which includes a top surface portion 12, a bottom surface portion 13, a left surface portion 14, and a right surface portion 15. Further, the socket body 11 includes upper and lower (first and second) terminal holding portions 16*a,* 16*b* each having the plurality of terminals 20 which are arranged in a row along the width direction of the socket body 11. The upper and lower terminal holding portions 16*a,* 16*b* are arranged so as to face with each other through a predetermined spacing 21.

As shown in FIGS. 1 and 2, both the upper and lower terminal holding portions 16*a,* 16*b* has a plurality of terminal accommodating compartments 17 which are arranged in a row in the width direction of the socket body. These compartments are seen to have a substantial comb teeth shape when viewed from the front side of the connector socket. The terminals 20 are held in the respective terminal accommodating compartments 17 of the terminal holding portions 16*a,* 16*b*. Such a structure makes it possible for the socket body 11 to hold the terminals 20 more reliably while preventing a short circuit between the adjacent terminals 20 effectively.

Further, each of the terminals 20 is formed from a metal plate to have a connection section of a substantial angular tube shape. As shown in FIG. 3, the connection section of each terminal 20 includes protruding contact portions 22 which protrude toward the inside of the connection section (i.e., toward the side in front of the drawing). The protruding contact portions 22 make contact with the contact pins 40 provided in the connector plug 30 (described later) to establish electrical connection therebetween. Further, the terminals 20 are arranged in the terminal accommodating compartments 17 in a row at a predetermined interval in the width direction of the socket body 11.

Further, as shown in FIGS. 2 and 3, each of the terminal accommodating compartments 17 of the terminal holding portions 16*a,* 16*b* has an insertion opening 18 at the front side thereof (at the front end surface of the socket body 11) into which the contact pins 40 provided in the connector plug 30 (described later) are inserted. Further, each terminal accommodating compartment 17 extends in the front and rear direction of the connector socket 10.

Furthermore, the upper and lower terminal holding portions 16*a,* 16*b* are positioned in the top and bottom direction of the socket body 11 in FIG. 2 with the spacing 21 being formed therebetween.

In the spacing 21, a rib 19 is provided substantially in the central portion of the width direction of both the terminal holding portions 16*a,* 16*b*. Further, the rib 19 is integrally formed with the terminal holding portions 16*a,* 16*b* to integrally connect the comb teeth portions of the terminal holding portions 16*a,* 16*b*. Furthermore, the rib 19 is continuously formed to run from the front sides to the rear sides of the terminal holding portions 16*a,* 16*b*.

By providing such a rib 19, the socket body 11 is prevented from being deformed so that both the terminal holding portions 16*a,* 16*b* approach to each other when the socket body 11 is softened by heat.

Namely, when the socket body 11 is formed by injection molding, the socket body 11 becomes in a softened state due to heat of itself during the interval from soon after it is taken out of a die until it is completely cooled. At this time, there is a case where the terminal holding portions 16*a,* 16*b* of the socket body 11 are deformed so that they approach to each other due to the residual stress inside the material at the time of injection molding, expansion of the resin material, or the like.

However, when the socket body 11 is softened by heat in this way, that is, when the socket body 11 becomes in a semi-molten state where it is not completely hardened, the rib 19 prevents both the terminal holding portions 16*a,* 16*b* from being warped inwardly by maintaining the spacing 21 between the terminal holding portions 16*a,* 16*b*. As a result, it is possible to reduce the yielding rate of poor quality products in manufacturing.

In the present embodiment, the rib 19 is continuously formed to run from the front sides to the rear sides of the terminal holding portions 16*a,* 16*b*, however, the present invention is not limited to the embodiment, and it is also possible to prevent the terminal holding portions 16*a,* 16*b* from being deformed toward the inside if the rib 19 is provided at least near the front sides of the terminal holding portions 16*a,* 16*b*.

Further, in the present embodiment, the number of the rib 19 is only one, but the present invention is not limited to the embodiment, and it is also possible to provide a plurality of ribs 19.

Furthermore, in the present embodiment, the upper and lower terminal holding portions 16*a,* 16*b* are provided in the height direction of the socket body 11, but the present invention is not limited to the embodiment, and it is also possible to provide three or more terminal holding portions 16.

As shown in FIG. 1, the connector plug 30 includes a plug body 31 formed of a resin, and a plurality of contact pins 40 mounted in the plug body 31.

The plug body 31 is formed to have a substantial box shape which includes a top surface portion 32, a bottom surface portion 33, a left surface portion 34, a right surface portion 35, and a rear surface portion 36. Further, the plug body 31 has in its interior portion a receiving space 37 for receiving the socket body 11 of the connector socket.

The rear surface portion 36 is provided with the contact pins 40 so that their base ends are protruded from the rear surface portion 36. Further, as shown in FIG. 1, the tip ends of the contact pins 40 are arranged inside the receiving space 37 in upper and lower rows so that these contact pins make contact with the terminals 20 of the connector socket 10 when the connector plug 30 is connected to the connector socket 10.

Further, a plate 38 which is integrally formed with the rear surface portion 36 is provided between the two rows of the contact pins 40 inside the receiving space 37, that is, in substantially the central portion of the height direction of the receiving space 37. When the connector socket 10 is fitted into the receiving space 37 of the plug body 31, the plate 38 is inserted into the spacing 21 between the terminal holding portions 16*a,* 16*b*. The plate 38 has a function of preventing a short circuit between the terminals 20.

Furthermore, the plate 38 includes a slit 39, which extends in the longitudinal direction, at substantially the central portion of the width direction thereof as shown in FIG. 1.

When the connector socket 10 is fitted into the receiving space 37 of the connector plug 30, the slit 39 allows the rib 19 to pass therethrough, and the rib 19 is positioned in the inside thereof.

By providing such a slit 39, it becomes possible to connect the connector socket 10 to the connector plug 30 in a smooth and stable manner.

Further, it is also possible that the connector 1 is provided with a plurality of the ribs 19 and the slits 39. However, in the case where the number of the ribs 19 and the slits 39 is increased, the plate 38 decreases in strength and in a function of preventing a short circuit between the terminals 20 due to the increase in the number of slits 39. For this reason, it is preferred that the connector 1 is provided with the necessary and sufficient number of the ribs 19 and the slits 39. In particular, there is no need that all the comb teeth shaped portions of the terminal holding portions 16*a,* 16*b* are provided with the ribs 19, and it is preferred that only some of the comb teeth shaped portions are provided with the ribs 19.

As has been described, the connector of the present invention includes deformation preventing means for preventing the upper and lower terminal holding portions from being deformed so that they approach to each other. For this reason, even when the connector becomes in a softened state by heat of itself after injection molding, the connector socket is prevented from being deformed so that the terminal holding portions thereof approach to each other.

Therefore, when the connector plug is inserted into the connector socket, the contact pins provided in the connector plug can be inserted into the insertion openings of the connector socket in a smooth and stable manner, so that the connector plug and the connector socket are reliably engaged with each other. Further, it is possible to reduce the yielding rate of poor quality products in manufacturing.

Finally, the present invention is not limited to the above-mentioned embodiment, and it goes without saying that various changes and modifications can be made without departing from the scope of the present invention which is determined by the following claims.

What is claimed is:

1. A connector including a connector socket and a mated connector plug to be connected to the connector socket, the connector socket and the mated connector plug being formed of a resin material by molding, wherein the connector socket comprises:

a socket body which includes first and second terminal holding portions each having a plurality of terminals which are arranged in a row along the width direction of the socket body, the first and second terminal holding portions being arranged so as to face each other through a predetermined spacing in upper and lower relationship; and means for preventing both the terminal holding portions from being deformed so that they approach each other after molding, the deformation preventing means being a rib which is arranged substantially at the center of the width direction of the socket body and integrally formed with the first and second terminal holding portions so as to connect these portions together; and wherein the mated connector plug comprises:

a plurality of contact pins which are arranged in upper and lower rows so as to correspond to the terminals of the connector socket;

a plate member which is integrally formed on the mated connector plug wherein the plate member is provided between the upper and lower rows of the plurality of contact pins; and a slit formed in the plate member for receiving the rib of the connector socket when the mated connector plug is connected to the connector socket;

wherein the plate member of the mated connector plug is adapted to be inserted into the spacing between the first and second terminal holding portions of the connector socket for preventing a short circuit between the terminals in the first and second terminal holding portions with the rib of the connector socket being received in the slit formed in the plate member of the mated connector plug.

2. The connector as claimed in claim 1, wherein each of the terminals has a tip portion and a base portion, and each of the first and second terminal holding portions has a front side in which the tip portion of each terminal is positioned and a rear side in which the base portion of each terminal is positioned, wherein the rib is formed so as to connect the front sides of the first and second terminal holding portions.

3. The connector as claimed in claim 2, wherein the rib is formed so as to connect the first and second terminal holding portions from the front sides thereof to the rear sides thereof.

* * * * *

UNITED STATES PATENT AND TRADEMARK OFFICE

CERTIFICATE OF CORRECTION

PATENT NO. : 6,666,727 B2
DATED : December 23, 2003
INVENTOR(S) : Konno et al.

It is certified that error appears in the above-identified patent and that said Letters Patent is hereby corrected as shown below:

Title page,
Item [73], Assignee, change "Mitbumi Electronic Co. LTD" to -- Mitsumi Electric Co., Ltd."

Signed and Sealed this

Fifteenth Day of February, 2005

JON W. DUDAS
*Director of the United States Patent and Trademark Office*